US005681388A

United States Patent [19]

Legrain et al.

[11] Patent Number: 5,681,388

[45] Date of Patent: Oct. 28, 1997

[54] APPLICATOR FOR MELTABLE PRODUCTS, IN PARTICULAR DEPILATORY WAX

[75] Inventors: Marc Legrain, Civrieux en Dombes; Daniel Combe, Jassan Riottier, both of France

[73] Assignee: SEB S.A., Selongey, France

[21] Appl. No.: 647,745

[22] Filed: May 15, 1996

Related U.S. Application Data

[62] Division of Ser. No. 261,061, Jun. 14, 1994, Pat. No. 5,556,468.

[30] Foreign Application Priority Data

Jun. 14, 1993 [FR] France ..... 93 07341

[51] Int. Cl.[6] ..... B05C 1/00

[52] U.S. Cl. ..... 118/202; 118/258; 401/1; 401/2

[58] Field of Search ..... 118/202, 258; 401/1, 2, 208

[56] References Cited

U.S. PATENT DOCUMENTS

| | | | |
|---|---|---|---|
| 538,297 | 4/1895 | Terry . | |
| 2,029,056 | 1/1936 | Carlson . | |
| 2,229,707 | 1/1941 | Testi . | |
| 2,285,105 | 5/1942 | Laszlo . | |
| 2,892,202 | 6/1959 | Williams . | |
| 3,048,880 | 8/1962 | Slomon . | |
| 3,083,397 | 4/1963 | Thomas . | |
| 3,100,908 | 8/1963 | Engle . | |
| 3,103,689 | 9/1963 | Borisof . | |
| 3,235,900 | 2/1966 | Klassen . | |
| 3,263,265 | 8/1966 | Judson . | |
| 3,284,839 | 11/1966 | Cook . | |
| 3,430,816 | 3/1969 | Nadherny et al. . | |
| 3,432,641 | 3/1969 | Wilke . | |
| 3,752,155 | 8/1973 | Blinoff, Jr. et al. . | |
| 3,858,985 | 1/1975 | Fiveash . | |
| 3,896,973 | 7/1975 | Morgan . | |
| 3,902,043 | 8/1975 | Rogan . | |
| 3,950,105 | 4/1976 | Moss et al. | 401/1 |
| 3,981,304 | 9/1976 | Szpur . | |
| 4,128,350 | 12/1978 | Ganache . | |
| 4,147,924 | 4/1979 | DeWitt, Jr. . | |
| 4,150,904 | 4/1979 | Stewart . | |
| 4,752,148 | 6/1988 | Mann . | |
| 4,865,034 | 9/1989 | Van der Molen | 401/1 |
| 4,889,440 | 12/1989 | Shano | 401/1 |
| 5,154,522 | 10/1992 | Nobilec | 401/1 |
| 5,219,237 | 6/1993 | Zonneveld | 401/1 |
| 5,236,269 | 8/1993 | Handry | 401/1 |

FOREIGN PATENT DOCUMENTS

| | | |
|---|---|---|
| 0055157 | 12/1981 | European Pat. Off. . |
| 0368698 | 5/1990 | European Pat. Off. . |
| 0380391 | 8/1990 | European Pat. Off. . |
| 2446616 | 1/1979 | France . |
| 2467786 | 10/1979 | France . |
| 8216474 | 9/1982 | France . |
| 1772/67 | 2/1967 | Switzerland . |
| 1023517 | 3/1966 | United Kingdom . |
| 1115861 | 5/1968 | United Kingdom . |
| 2113994 | 8/1983 | United Kingdom . |
| 2 187 950 | 9/1987 | United Kingdom . |

*Primary Examiner*—Laura Edwards
*Attorney, Agent, or Firm*—Loeb & Loeb LLP

[57] ABSTRACT

An applicator for a meltable product comprising: a case, a reservoir for holding a quantity of the product, the reservoir having an outlet opening and being made at least in part of a thermally conductive material, heating means in thermal communication with the reservoir, and an applicator roller disposed in the outlet opening, wherein the applicator roller comprises a core composed at least partly of thermally conductive material and a layer of plastic material surrounding the core. An applicator in combination with an extraction gripper for gripping the roller, the gripper comprising two arms which extend substantially parallel to one another, each arm having a projecting finger positioned such that the projecting finger on one of the arms faces the projecting finger on the other one of the arms, the projecting fingers being located and configured to cooperate with the engagement elements of the roller in order to grip the roller.

15 Claims, 4 Drawing Sheets

APPLICATOR FOR MELTABLE PRODUCTS, IN PARTICULAR DEPILATORY WAX

This is a division of application Ser. No. 08/261,061, filed on Jun. 14, 1994, now U.S. Pat. No. 5,556,468.

BACKGROUND OF THE INVENTION

The present invention relates to the general technical field of devices for applying products which are meltable or softenable by application of heat, such as depilatory wax, ointments, creams, or even glues or varnishes. These products are stored in solid form at room temperature, and must be subjected to a thermal flux in order to undergo a change of state and pass into a less viscous, or more fluid, or flowable, state in order to be applied. The products to which this invention relates, and which have the above properties, will be referred to hereinafter as meltable, the term being used herein to encompass products which are either liquifiable or softenable to a flowable state.

The present invention concerns more particularly an applicator for meltable products, in particular depilatory wax, comprising a housing associated with a gripping means, a reservoir for the product to be applied in thermal communication with heating means and at least one applicator roller disposed in the vicinity of an outlet orifice of the reservoir.

The present invention equally concerns in an advantageous manner an extraction gripper, or pliers for an applicator roller mounted on an applicator according to the invention, as well as an assembly for applying meltable products comprising the meltable product applicator itself associated with the extraction gripper. Meltable products include, according to the invention, all types of products capable of having, at room temperature, a solid, semi-solid or pasty state, but changing, when heat is applied thereto, their physical state in the direction toward a liquid state capable of permitting the product to spread out in the form of a thin layer. The invention is particularly directed to depilatory wax applicators, but it is evident that the meltable product applicator according to the invention is not in any way limited to this specific use, and that meltable products such as waxes and glues can be applied with the aid of an applicator according to the invention.

Regardless of the type of depilatory wax applicator considered, the technique of hair removal by the application of a depilatory wax consists in melting or softening a certain quantity of wax, then applying a layer of this wax, in a molten or softened state, to the region from which hair is to be removed. After hardening, that is to say after cooling, of the wax, a film of cold wax is created and is then peeled away from the skin with the aid of any appropriate means, hairs being then plucked from the skin as a result of their being embedded in the wax.

This widely used technique can be implemented with known ready-to-use hot wax distributors constituted by a reservoir for wax which is heated by any suitable means, for example by an apparatus analogous to a water heater. These devices are completed by a simple wax distributing roller which is independent of the reservoir and which the user introduces into the wax mass in order to coat it with a quantity of wax. These devices, which are rather primitive, have been found to no longer meet the needs of users of depilatory wax particularly in view of the numerous inconveniences associated with their use. Thus, the temperature of application of the wax is practically uncontrollable as well as, moreover, the thickness to which the wax layer is applied. These devices are also considered to be cumbersome and give rise to a hair removal operation which is lengthy, tedious, often messy and typically wastes a certain quantity of wax.

Improved devices for this purpose have been proposed, for example as disclosed in French application number FR-A-2520601. That patent discloses an applicator assembly including a case provided with heating enclosures in which are housed manual applicators which are to be used by an individual. These applicators are provided with an internal depilatory wax reservoir and a wax applicator roller. Such an applicator of course constitutes an improvement over previous devices, but it does not completely resolve the essential problem of mastery of the wax application temperature. In effect, heating of the wax occurs only in a discontinuous, or periodic, manner when the applicator is in the heating enclosure. It is found, consequently, that after a certain application period, the temperature of the wax decreases rapidly and is thus no longer at or near the optimum temperature. As a result, application of the wax becomes increasingly difficulty. In particular, there appears a phenomenon whereby wax threads or filaments appear, which has a negative influence on the quality of the hair removal. This drawback is accompanied by an excessive consumption of wax and a heterogeneous application which in the end leads to an unsatisfactory depilatory operation. In order to partly alleviate this problem, the user is obliged to frequently return the applicator into a heating enclosure. However, this prolongs the time required for the entire depilatory operation to an undesirable extent, without at the same time guaranteeing a better mastery of the temperature of the wax or for that matter a better final result.

It has thus been proposed, in order to remedy at least in part the shortcomings of applicator devices in which the heating reservoir is separated from the application unit, to provide, for example as described in European application A-0368698, a manual applicator including in the same case, a wax reservoir, a heating resistance and an applicator roller. In order to facilitate application of the wax, and also to better control the temperature of the wax, the applicator roller is provided with its own heating means. Such a device assures an improved control of the temperature at which the wax is applied and reduces in a certain manner the risk of appearance of the threads or filaments mentioned previously. The presence of a heating means directly in the applicator roller can create the risk of overheating of the wax and burning of the user's skin. In addition, such a device has been found to present certain design and manufacturing difficulties to the extent that it requires the installation of two heating means which are separated in a case. In the end, the reliability of such a device is not assured and its cost has been found to be high.

SUMMARY OF THE INVENTION

An object of the present invention is to overcome the difficulties and shortcomings mentioned above.

A more specific object of the invention is to provide a meltable product applicator whose design and structure are simplified, while permitting a mastery and optimal control of the application temperature of the product.

Another object of the invention is to provide an applicator for meltable products whose different parts are particularly simple to fabricate and assemble.

Another object of the invention is to provide an applicator for meltable products whose use is facilitated when being loaded with meltable products and during disassembly and cleaning.

Another object of the invention is to provide an extraction gripper for a meltable product applicator roller, the gripper mounted on the applicator to permit an extraction and easy manipulation, without risk of soiling the environment after extraction.

The above and other objects are achieved, according to the present invention, by the provision of an applicator for a meltable product comprising: a case, a reservoir for holding a quantity of the product, the reservoir having an outlet opening and being made at least in part of a thermally conductive material, heating means in thermal communication with the reservoir, and an applicator roller disposed in the outlet opening, wherein the applicator roller comprises a core composed at least partly of thermally conductive material and a layer of plastic material surrounding the core.

The objects according to the invention are also achieved with the aid of an extraction gripper for a meltable product applicator roller of an applicator according to the invention, the gripper having two arms which extend substantially parallel to one another, each arm having a projecting finger positioned such that the projecting finger on one of the arms faces the projecting finger on the other one of the arms, the projecting fingers being located and configured to cooperate with the engagement elements of the roller in order to grip the roller.

Various other objects, features and characteristics of the invention will become more readily apparent from the following description of preferred embodiments, which will be presented with reference to the drawing.

DESCRIPTION OF THE PREFERRED EMBODIMENTS

Figure 1:
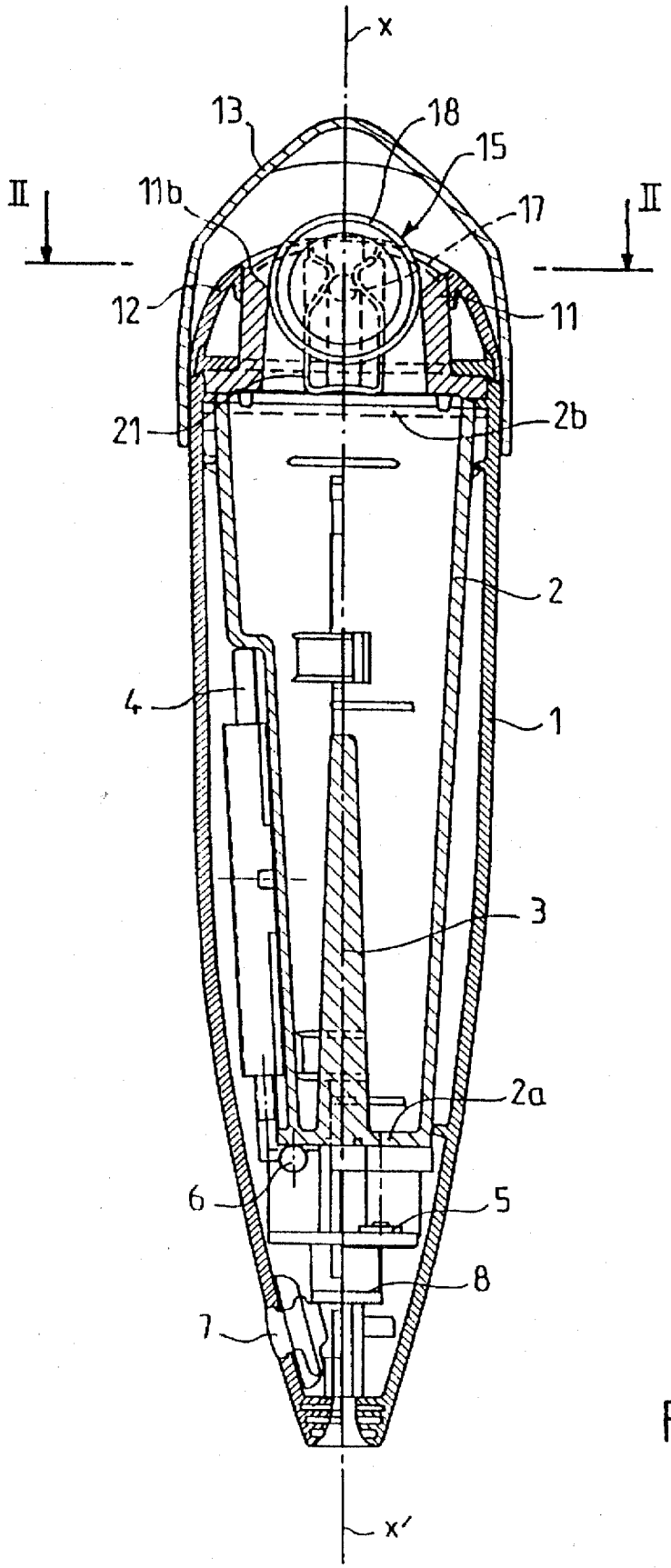
FIG. 1 is a longitudinal cross-sectional view of a product applicator according to a preferred embodiment of the invention.

The applicator for a meltable product, as shown in FIG. 1 is particularly intended for applying depilatory wax and includes a case 1 made, for example, of a plastic material, case 1 presenting a generally elongated form having a longitudinal axis x–x'. Case 1 has a transverse cross section of any desired form and may be, for example, substantially circular. Advantageously, case 1 includes a gripping means capable of permitting the user to easily hold it. At the interior of case 1 there is installed a reservoir 2 made of a material which is a good heat conductor and provided for the storage of a product to be applied. Advantageously, reservoir 2 is made of aluminum, extends substantially along all of the central part of case 1 along axis x–x' and includes a bottom 2*a* and an opening 2*b* at its top. Advantageously, reservoir 2 is provided in its central zone with a blade, or fin, 3. Blade 3 is provided for diffusing, or distributing, heat and extends within the internal volume of reservoir 2 starting from bottom 2*a*. Reservoir 2 is in thermal communication with heating means 4 constituted, for example, by an electric resistance or a CTP (conductive plastic) at least partially surrounding reservoir 2 or, as shown in FIG. 1, attached to a wall of reservoir 2.

As is conventional, heating means 4 is associated with heat control means such as a thermostat 5 and a fuse 6. Advantageously, the applicator according to the invention is provided with a power supply indicator 7 which is visible from the exterior via an opening arranged in the wall of case 1. The electric system assembly, which includes electrical connections and means for securing an electric cord (not shown), is preferably mounted on a support flange 8 installed in the lower part of case 1, beneath bottom 2*a* of blade 3.

The upper zone of case 1 is advantageously constituted by a head 11 which may, for example, be screwed on to the upper part of reservoir 2 and which then surmounts the upper party as well as top opening 2*b* of reservoir 2. Head 11 has an upper extremity 11*b* which delimits a geometric envelope constituting the actual outlet orifice for the molten or softened wax.

Figure 2:
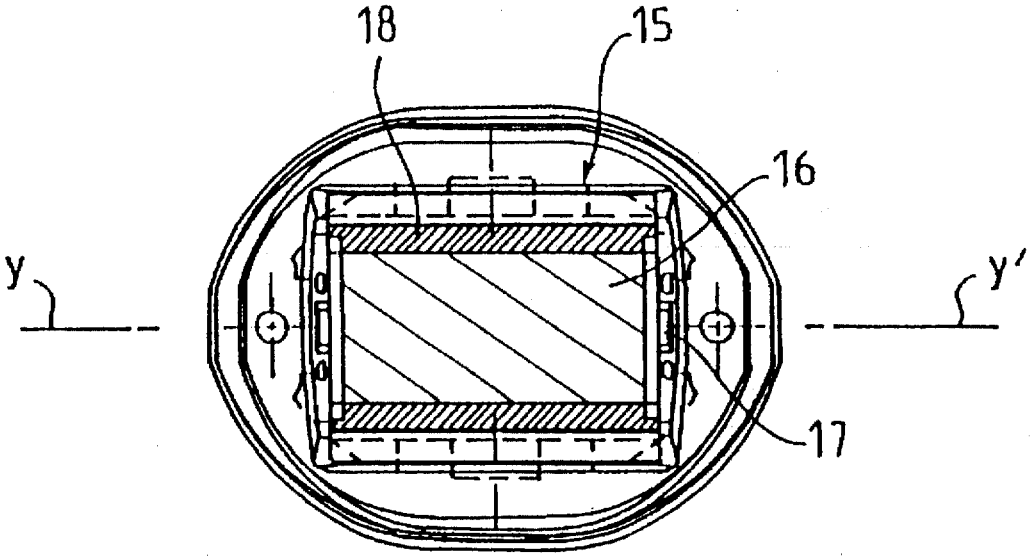
FIG. 2 is a cross-sectional view taken along the line II—II of FIG. 1.

The product applicator according to the invention also includes an applicator roller 15 mounted to rotate about a longitudinal axis y–y' (FIG. 2). Roller 15 is disposed in the outlet orifice of reservoir 2 in a manner to permit the flow of liquid or softened wax on the periphery of applicator roller 15 and between applicator roller 15 and the internal face of head 11. Roller 15 is constituted by a core 16 made of a material which is a good heat conductor, such as for example aluminum. Core 16 is preferably cylindrical and of circular cross section and is provided at each of its two opposed ends, constituting the lateral faces of applicator roller 15, with a bearing, or pin, 17. Bearings 17 are formed, for example integrally with core 16, for example by machining of the ends of a body used to form applicator roller 15, bearing 17 extending along axis y–y' and defining the axis of rotation of applicator roller 15.

Core 16 is surrounded, preferably over the entirety of its peripheral surface, by a plastic material coating, or covering, advantageously molded around core 16. The plastic coating forms a layer 18 via which wax will be applied to the user's skin. Layer 18 can be constituted by any suitable, commercially available plastic composition selected on the basis of knowledge possessed by those skilled in the art.

Figure 2A:
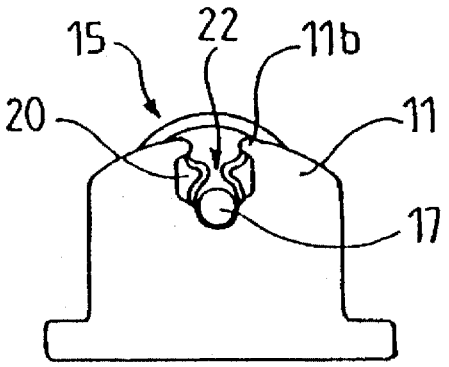
FIG. 2*a* is a side detail view showing the construction of an upper part of the applicator of FIG. 1.

Applicator roller 15 is mounted on head 11 and supported thereon through the intermediary of bearings 17 which form the connecting means with the applicator body. In an advantageous manner, applicator roller 15 is mounted in a removable manner on head 11 through the intermediary of openings 20 which are open at the upper extremity of head 11 and extend across the thickness dimension of each of the opposed faces of head 11. Slots 20 are open at their upper extremity and thus permit the passage of bearings 17 which then come to rest at the base of each of slots 20. (FIG. 2*a*).

Maintenance of each bearing 17 in position at the base of each slot 20 is assured by the intermediary of a retaining means capable of being displaced in order to permit the removability and the extraction of applicator roller 15. For this purpose, the retaining means are advantageously constituted by a clip 21 having a generally U-shaped form. A respective clip 21 is mounted in a fixed manner along and against each one of slots 20, with the open end of the U coinciding with the open end of the respective slot 20. Each clip 21 includes two lateral arms extending substantially in the same direction as slots 20, the arms forming between them a narrowed region 22 in the upper party of clip 21, the narrow region serving to block each bearing 17 in the base of each slot 20. Clip 21 is made of a metallic material having an elasticity sufficient to permit its lateral arms to deform elastically during insertion and extraction of bearings 17 into and out of slots 20, and across the narrowed portion 22.

By making applicator roller 15 of two materials, including a core 16 based on a material which is a good conductor of heat, it is possible to avoid an undesirably high thermal loss by the wax during the application operation, by storage of a portion of the thermal energy of the liquid or pasty wax in core 16. The thermal losses are thus limited to the extent that the thermal conduction between the walls of reservoir 2 and applicator roller 15 is improved significantly by the intermediary of the thermal bridges constituted by bearings 17 which, in addition to their mechanical support function, thus assume a thermal conductor function. Optimization of the wax application temperature requires however avoidance of any risk of burning the user's skin, and at the same time prevention of the appearance of wax threads or filaments. The presence of layer 18 made of plastic material serves to prevent burning of the skin. For this purpose it has been found desirable to maintain specific ratios between the thickness "e" of layer 18 and the radius "R" of core 16. Specifically, it has been found that a ratio of e/R of between 0.3 and 0.5, and preferably substantially equal to 0.4, would provide satisfactory results for a representative sample of the various depilatory waxes available.

The plastic material of layer 18 may be a thermoset, or, preferably, a thermoplastic such as a polyamide, polypropylene, or polycarbonate.

The applicator according to the invention advantageously includes a head cover 12 which is disposed against head 11 as an extension of case 1. A closing cap is removably installed on the upper part of the applicator.

Figure 3:
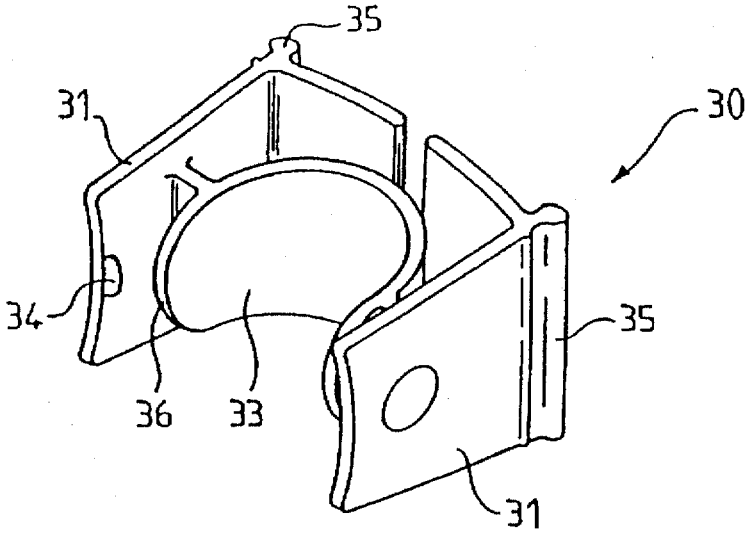
FIG. 3 is a perspective view of one embodiment of an extraction gripper according to the invention.

Installation or extraction of applicator roller 15 can of course be performed by ripping it directly, but these operations are preferably performed with the aid of an extraction gripper 30 (FIG. 3). Gripper 30 has two arms 31 which extend substantially parallel to one another and between which is formed an opening/closing system which is advantageously constituted, in the illustrated embodiment, by a semicircular piece 33 of resiliently elastic material. The unstressed shape and elasticity of piece 33 are such that arms 31 adopt a stable position as shown in FIGS. 3–6 in which the distance between arms 31 is slightly less than the length of applicator roller 15. Each arm 31 is provided on each of its internal faces and substantially toward an extremity, with a gripping finger 34, the two fingers 34 being disposed in opposition to, or facing, one another. The end of each arm 31 which is remote from its associated finger 34 has a support foot 35 formed to permit extraction gripper 30 to rest in a stable manner, via feet 30, on a supporting surface, as shown in FIG. 6.

Figure 4:
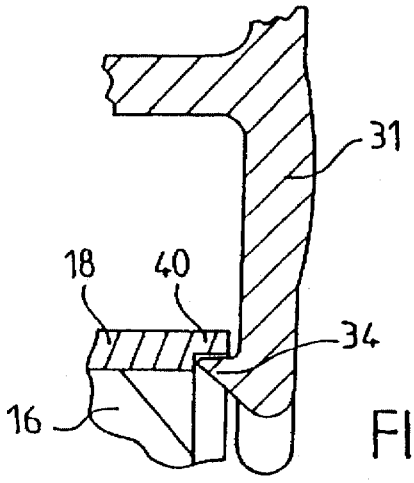
FIG. 4 is a cross-sectional detail view showing one arm of the gripper of FIG. 3.

Fingers 34 are intended to cooperate with engagement elements 40 arranged, as shown in FIG. 4, on and in the lateral walls of applicator roller 15. In an advantageous manner, engagement elements 40 are constituted by circular lips projecting axially beyond the lateral walls of applicator roller 15. Also advantageously, the circular lips are integral parts of layer 18. According to another form of construction, engagement elements 40 can be constituted by grooves formed in the body of core 16.

Extraction gripper 30 also includes at least one and preferably two support pieces 36 disposed between arms 31 and capable of coming in contact with layer 18 when extraction gripper 30 is brought into engagement with applicator roller 15, while on the other hand elements 40 cooperate with fingers 34 (FIGS. 4 and 6). In the example shown in FIGS. 3 and 6, support pieces 36 are constituted by extremities of piece 33.

Figure 7:
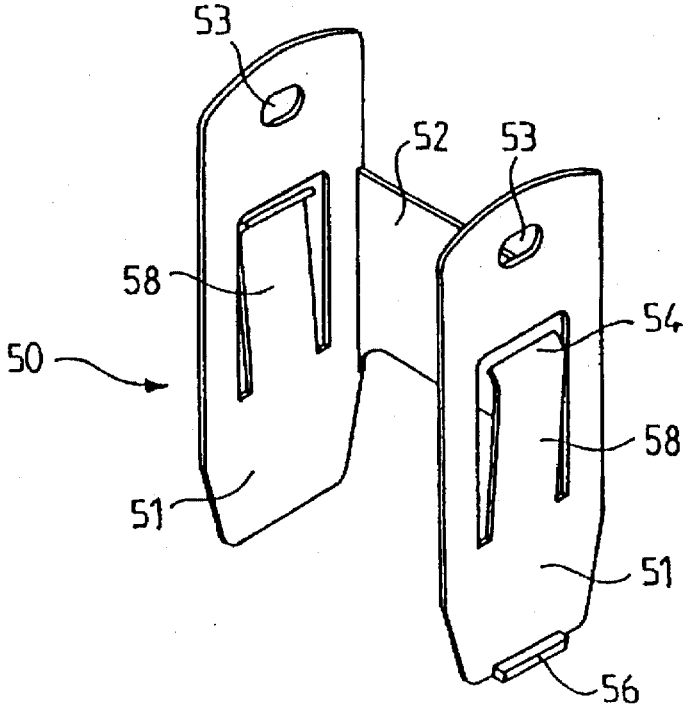
FIG. 7 is a perspective view of a support slide for an applicator roller according to the invention.
Figure 8:
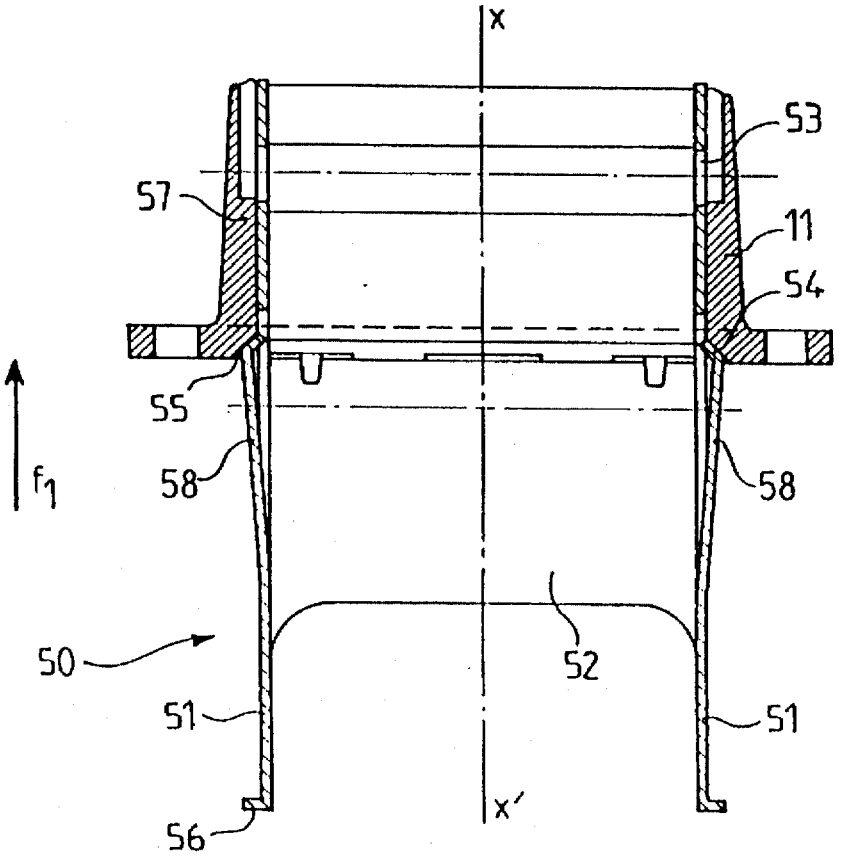
FIG. 8 is a cross-sectional view showing the support slide of the applicator roller in the case of an applicator according to the invention.

FIGS. 7 and 8 show a preferred alternative embodiment of the invention in which applicator roller 15 is mounted to be displaceable on, and relative to, case 1 between a working position in which a wax film is to be applied and in which applicator roller 15 extends within upper extremity **11*b* of reservoir 2, and a position for clearing, or unblocking, upper extremity 11*b* in order to permit refilling of reservoir 2. Roller 15 is fixed to a slide member 50 which is slidable in the direction of axis x–x' within case 1 and preferably on head 11 that forms the upper part of case 1. Slide member 50 includes two legs 51 extending substantially parallel to one another, and rigidly connected together in positions of mutual opposition via a crosspiece 52. Each leg 51 is provided at its upper end with a through-hole 53 oriented to support a respective bearing 17 of applicator roller 15**.

Slide member 50 is intended to be inserted into the body of case 1, with legs 51 sliding against the internal faces of head 11, as can be seen from a consideration of FIG. 8. Each of legs 51 has a central part provided with a blocking tongue 58 forming an integral part of its associated leg 51. Each tongue 58 terminates at its upper extremity in a free edge 54 which is bent in the direction toward axis x–x'. Each free edge 54 is intended to engage, when slide member 50 is in its lowered, or retracted, working position, and inclined surface 55 formed in the lower part of head 11 in order to block slide member 50 in that position. Blocking tongues 58 have a sufficient elasticity to deform in the direction of axis x–x' and permit, upon gripping of applicator roller 15, retraction of edges 54 past surfaces 55, followed by sliding of slide member 50 in the direction of arrow $f_1$ of FIG. 8 out of upper extremity **11*b* up to its upper disengagement or clearing position. Advantageously, slide member 50 is provided, toward the lower end of each leg 51, with a respective external abutment 56 adapted to engage head 11 adjacent surfaces 55 when slide member 50 is in its upper position, to thereby prevent complete removal of slide member 50 from reservoir 2. Such an arrangement does not reduce the transmission of thermal energy to core 16, because in the working position, bearings 17 are supported by columns 57 arranged in head 11**.

An applicator for meltable, or hot melt, products according to the invention functions in the following manner.

The user proceeds first of all to extract applicator roller 15 in order to obtain access to the interior of reservoir 2 in order to assure filling with depilatory wax via top opening **2*b*. In order to do this, the extraction can take place manually or with the aid of extraction gripper 30. In the latter case, the user grips, between their fingers, arms 31 and lightly separates them in opposition to the restoring force exerted by piece 33. Extraction gripper 30 is then placed on applicator roller 15 in a manner such that arms 31 enclose the lateral faces of applicator roller 15 (FIG. 4). Each finger 34 thus cooperates with a respective element 40 with which it is associated. By releasing the manual force on arms 31, they then come to firmly grip elements 40 by means of each finger 34. The user can then slide bearings 17 along reservoir 20 and extract applicator roller 15 by producing a force greater than the elasticity of the lateral arms of clips 21. After having proceeded with filling of reservoir 2, applicator roller 15 is reinstalled by a series of operations inverse to those described above, support pieces 36 permitting transmission to bearings 17 of the force necessary to spread apart, at the level of narrowed region 22 of the lateral arms of clip 21**.

After connection of the applicator to an electric power source, the wax becomes progressively softer and less viscous and the user can then place applicator roller 15 in contact with the surface from which hair is to be removed in order to permit flow of liquified wax upon layer 18. Upon completion of application of depilatory wax, the user can, for example to perform a cleaning operation, extract applicator roller 15 with the aid of extraction gripper 30 by performance of the steps described earlier herein. Use of an extraction gripper 30 eliminates the need to make direct manual contact with applicator roller 15 which is still coated with a certain quantity of depilatory wax, and also permits applicator roller 15 to be put down without risk of soiling surrounding surfaces by placing feet 35 of extraction gripper 30 on a support surface.

The invention also concerns an applicator assembly for meltable products including in combination a meltable product applicator as well as an extraction gripper 30. In addition, the applicator assembly can include a base (not shown) for supporting and storing the applicator as well as the gripper. Advantageously, the base can be provided with a timer, in particular with an audible signal generator, permitting the user, after having connected the applicator to an electric power source, to keep track of the average time necessary for melting of the depilatory wax.

Figure 5:
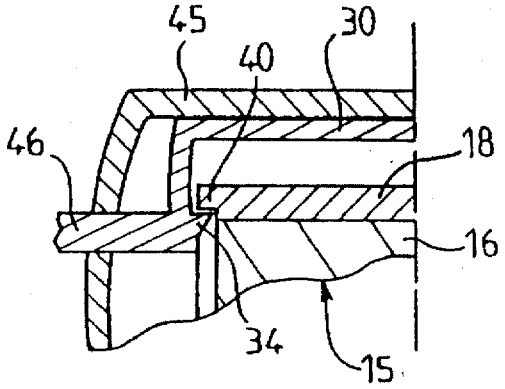
FIG. 5 is a cross-sectional detail view of a portion of an applicator according to the invention, showing a portion of a second embodiment of an extraction gripper according to the invention.
Figure 6:
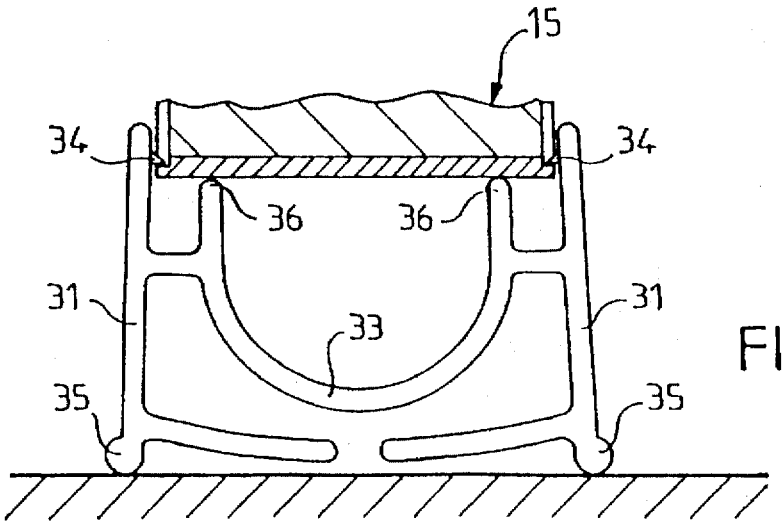
FIG. 6 is a side elevational view showing the gripper of FIG. 3 mounted in a storage position on an applicator roller support.

By way of a modification of that which has been described above, it is possible to not form extraction gripper 30 as an element separate from the applicator, such as shown in FIG. 3, but rather to integrate extraction gripper 30 into a cap 45 for closing the applicator head, as shown in FIG. 5. In this modified form of construction, extraction gripper 30 is fixed to cap 45 and is provided on its lateral arms with push buttons 46 passing through openings in cap 45 so as to be capable of being actuated by the user. Buttons 46 permit, when one wishes to extract the applicator roller, fingers 34 to be moved in order to permit engagement thereof with elements 40. The removability of applicator roller 15 is then obtained by simultaneous extraction of cap 45 and applicator roller 15. The extraction of cap 45 can be obtained without extracting applicator roller 15 by not acting on buttons 46.

In FIG. 5, gripper 30 is shown in the condition where buttons 46 are being actuated, i.e. being pushed horizontally toward one another. When buttons 46 are not being actuated, fingers 34 will be displaced away from engagement with elements 40.

This application relates to subject matter disclosed in French Application number 93 07341, filed on Jun. 14, 1993, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. An applicator for a depilatory wax, said applicator comprising a case, gripping means associated with such case; a reservoir for depilatory wax, said reservoir having an outlet opening; heating means in thermal communication with said reservoir; and at least one applicator roller disposed in the outlet opening, wherein said at least one applicator roller is displaceably mounted on said case for displacement between a working position in which said roller is located within said outlet opening, and a position in which said roller is withdrawn from said opening in order to permit filling of said reservoir, said applicator further comprising a slide member to which said at least one applicator roller is fixed, said slide member being mounted to be slidable in said case.

2. Applicator according to claim 1 wherein said slide member is mounted in an upper part of said reservoir.

3. Applicator according to claim 2 wherein said slide member comprises two legs and a cross piece, said legs extending substantially parallel to one another and being rigidly connected together in positions of mutual opposition via said cross piece, each of said legs having an upper end provided with a through-hole, said through-hole in one of said legs being axially aligned with said through-hole and the other of said legs, and said at least one applicator roller comprises bearings which are supported in said through-holes.

4. Applicator according to claim 3 wherein: said case comprises a head which delimits said opening of said reservoir and which has a lower portion provided with inclined surfaces; and each of said legs has a central part provided with a blocking tongue forming an integral part of its associated leg, each said tongue terminating at an upper extremity in a free edge which is disposed to engage, when said sliding member is in its working position, a respective inclined surface of said head in order to block said slide member in position.

5. Applicator according to claim 4 wherein said blocking tongues have an elasticity sufficient to permit said blocking tongues to be deformed toward one another and to permit, upon gripping of said at least one applicator roller, retraction of said free edges past said inclined surfaces and sliding of said slide member out of said opening to an upper disengagement position.

6. Applicator according to claim 5 wherein said slide member is provided, toward the lower end of each of said legs, with external abutment members for engaging said inclined surfaces when said slide member is in its upper disengagement position in order to prevent complete removal of said slide member from said reservoir.

7. Applicator according to claim 1 wherein said slide member comprises two legs and a cross piece, said legs extending substantially parallel to one another and being rigidly connected together in positions of mutual opposition via said cross piece, each of said legs having an upper end provided with a through-hole, said through-hole in one of said legs being axially aligned with said through-hole and the other of said legs, and said at least one applicator roller comprises beatings which are supported in said through-holes.

8. Applicator according to claim 7 wherein: said case comprises a head which delimits said opening of said reservoir and which has a lower portion provided with inclined surfaces; and each of said legs has a central part provided with a blocking tongue forming an integral part of its associated leg, each said tongue terminating at an upper extremity in a free edge which is disposed to engage, when said sliding member is in its working position, a respective inclined surface of said head in order to block said slide member in position.

9. Applicator according to claim 8 wherein said blocking tongues have an elasticity sufficient to permit said blocking tongues to be deformed toward one another and to permit, upon gripping of said at least one applicator roller, retraction of said free edges past said inclined surfaces and sliding of said slide member out of said opening to an upper disengagement position.

10. Applicator according to claim 9 wherein said slide member is provided, toward the lower end of each of said legs, with external abutment members for engaging said inclined surfaces when said slide member is in its upper disengagement position in order to prevent complete removal of said slide member from said reservoir.

11. Applicator according to claim 10 wherein said reservoir is made of aluminum.

12. An applicator for a meltable product comprising: a case, a reservoir in said case for holding a quantity of the product, the reservoir having an outlet opening, heating means in thermal communication with the reservoir, an applicator roller disposed in the outlet opening, wherein said applicator roller comprises a core composed at least partly of thermally conductive material and a layer of plastic material surrounding and covering said core for delivering the product, and means coupling said applicator roller to said reservoir for transferring heat to said core from said reservoir by thermal conduction and from the product.

13. Applicator according to claim 12 wherein said heating means are attached to said reservoir.

14. Applicator according to claim 13 wherein said reservoir is fixed in said case.

15. Applicator according to claim 14 wherein said case is held by a user while the product is being delivered and said heating means supply heat energy to said reservoir while the product is being delivered.

* * * * *